US010465874B2

(12) United States Patent
Kamau et al.

(10) Patent No.: US 10,465,874 B2
(45) Date of Patent: Nov. 5, 2019

(54) LIGHTING DEVICE FOR VEHICLES

(71) Applicant: Hella KGaA Hueck & Co., Lippstadt (DE)

(72) Inventors: Edwin N. Kamau, Bonn (DE); Franziska Kley, Geseke (DE)

(73) Assignee: Hella KGaA Hueck & Co., Lippstadt (DE)

( * ) Notice: Subject to any disclaimer, the term of this patent is extended or adjusted under 35 U.S.C. 154(b) by 0 days.

(21) Appl. No.: 15/787,997

(22) Filed: Oct. 19, 2017

(65) Prior Publication Data

US 2018/0106450 A1 Apr. 19, 2018

(30) Foreign Application Priority Data

Oct. 19, 2016 (DE) ..... 10 2016 119 880

(51) Int. Cl.

| | |
|---|---|
| ***F21S 41/20*** | (2018.01) |
| ***F21S 41/141*** | (2018.01) |
| ***F21S 41/43*** | (2018.01) |
| ***F21V 5/00*** | (2018.01) |
| ***F21V 17/10*** | (2006.01) |
| ***F21S 41/143*** | (2018.01) |
| ***F21S 41/265*** | (2018.01) |
| ***F21S 41/275*** | (2018.01) |
| ***F21S 41/47*** | (2018.01) |
| ***F21Y 115/10*** | (2016.01) |
| ***F21S 41/25*** | (2018.01) |

(52) U.S. Cl.

CPC ..... *F21S 41/285* (2018.01); *F21S 41/141* (2018.01); *F21S 41/143* (2018.01); *F21S 41/265* (2018.01); *F21S 41/275* (2018.01); *F21S 41/43* (2018.01); *F21S 41/47* (2018.01); *F21V 5/002* (2013.01); *F21V 17/101* (2013.01); *F21S 41/25* (2018.01); *F21Y 2115/10* (2016.08)

(58) Field of Classification Search

CPC ..... F21S 41/285; F21S 41/141; F21S 41/43; F21S 48/115; F21S 48/1225; F21S 48/145; F21V 5/002; F21V 17/101; F21V 2115/10

See application file for complete search history.

(56) References Cited

U.S. PATENT DOCUMENTS 6,373,633 B1 * 4/2002 Brown ..... B23K 26/0604 359/618
6,656,373 B1 * 12/2003 Neal ..... G01J 9/00 216/12
7,116,404 B2 * 10/2006 Lof ..... G03F 7/70275 355/67

(Continued)

FOREIGN PATENT DOCUMENTS

AT 514967 A1 5/2015
GB 2079919 * 6/1980 ..... F21V 13/00

*Primary Examiner* — Thien M Le
*Assistant Examiner* — Asifa Habib
(74) *Attorney, Agent, or Firm* — Muncy, Geissler, Olds & Lowe, P.C.

(57) ABSTRACT

A lighting device for vehicles having a light source and having an optical unit for generating a predetermined light distribution, wherein the optical unit has a micro-optical array having a plurality of micro-optical elements and a microshutter array having a plurality of microshutter elements, wherein the microshutter array has a thickness in the range of 0.1 mm to 2.00 mm.

11 Claims, 4 Drawing Sheets

(56) References Cited

U.S. PATENT DOCUMENTS

| | | | | |
|---|---|---|---|---|
| 7,433,122 | B2 * | 10/2008 | Peterson | G03B 21/602 359/443 |
| 7,480,098 | B2 * | 1/2009 | Oh | G02F 1/133526 264/1.1 |
| 7,502,169 | B2 * | 3/2009 | Wood | G02B 27/10 |
| 7,646,538 | B2 * | 1/2010 | Gardner | G02B 26/125 248/683 |
| 9,551,868 | B2 * | 1/2017 | Yamakawa | G02B 27/286 |
| 9,871,588 | B2 * | 1/2018 | Shatz | G06K 9/00671 |
| 2004/0017612 | A1 * | 1/2004 | Fadel | G02B 3/0012 359/619 |
| 2016/0109808 | A1 * | 4/2016 | Zeng | G03F 7/20 |
| 2016/0265733 | A1 * | 9/2016 | Bauer | G02B 3/0006 |
| 2017/0146806 | A1 * | 5/2017 | Lin | G02B 21/004 |
| 2017/0370773 | A1 * | 12/2017 | Kim | G01J 3/12 |

* cited by examiner

LIGHTING DEVICE FOR VEHICLES

This nonprovisional application claims priority under 35 U.S.C. § 119(a) to German Patent Application No. 10 2016 119 880.3, which was filed in Germany on Oct. 19, 2016, and which is herein incorporated by reference.

BACKGROUND OF THE INVENTION

Field of the Invention

The invention relates to a lighting device for vehicles having a light source and having an optical unit for generating a predetermined light distribution, wherein the optical unit has a micro-optical array having a plurality of micro-optical elements and a microshutter array having a plurality of microshutter elements.

Description of the Background Art

From AT 514967 B1, which corresponds to US 2016/0265733, a lighting device for vehicles is known which comprises a light source and an optical unit having a micro-optical array and a microshutter array. The micro-optical array has a micro-optical entry panel and a micro-optical exit panel, which each have micro-optical entry elements or micro-optical exit elements on a side facing away from one another. Between the micro-optical entry panel and the micro-optical exit panel, the microshutter array is arranged, which comprises a plurality of microshutter elements associated with the respective micro-optical entry elements or micro-optical exit elements of the micro-optical entry panel or the micro-optical exit panel. The microshutter elements have a contour such that a light distribution with a predetermined light/dark cut-off can be generated. The microshutter array is formed as a vapor-deposited layer or as a planar sheet, in which respective apertures for the passage of light are provided. A disadvantage of the known lighting device is that a per-channel separation of the light control is not possible. Light that passes through a first micro-optical entry element, a microshutter element arranged downstream of the main emission, and a further micro-optical exit element disposed downstream, can be deflected as scattered light partially into a different channel (adjacent micro-optical entry element, microshutter element, micro-optical exit element). This can lead to unwanted optical effects, such as "ghost images". With relatively great expense, such "ghost images" must be hidden using shutters, so-called "light traps".

SUMMARY OF THE INVENTION

It is therefore an object of the present invention to further develop a lighting device for vehicles having a light source and having an optical unit with a micro-optical array and a microshutter array in such a way that with little expense, predetermined light distributions with defined light patterns can be generated.

To achieve this object, an embodiment of the invention provides that the microshutter array has a thickness in the range of 0.1 mm to 2.00 mm.

According to an embodiment of the invention, a microshutter array having a thickness ranging from 0.1 mm to 2.00 mm is provided. Surprisingly, it has been found that by using a relatively "thick" shutter array, otherwise present scattered light can be minimized. Significantly improved channel separation in the optical unit can result, wherein a channel can be formed by at least a micro-optical element and a microshutter element arranged in the main emission direction, downstream of the latter. Advantageously, a homogeneous light distribution can be provided with a predetermined light pattern including light/dark cut-offs without the need for the unwanted scattered light having to be "filtered out" by additional shutters (light trap). The inventive optimization of the microshutter array enables an efficient and compact construction of the lighting device.

According to an embodiment of the invention, the microshutter elements may have a contour so that light passing through the respective microshutter elements pass through a plurality of micro-optical elements arranged side by side in the plane of the micro-optical array. A microshutter element is thus assigned to several micro-optical elements of the same micro-optical array. Advantageously, more light can thereby pass through the "channels" of the optical unit so that the luminous flux is increased. In addition, the microshutter array can thereby be manufactured more easily.

According to an embodiment of the invention, a portion of or all of the microshutter elements are each assigned to a single micro-optical element of the same micro-optical array. The microshutter elements can each have the same contour. Advantageously, hereby a light distribution with a predetermined light/dark cut-off can be generated.

According to an embodiment, the microshutter array can be formed as, for example, an injection-molded part, which can be manufactured by injection molding. Because of its rigid configuration, the micro-optical array can be utilized to adjust or retain the micro-optical array. When using several micro-optical arrays transversely to the main emission direction, the micro-optical array can also serve to adjust and retain the plurality of micro-optical arrays.

According to an embodiment of the invention, the micro-optical array can be formed solely of a light exit panel having a plurality of micro-optical exit elements. The microshutter array can be arranged in the main emission direction, at a distance behind the light exit panel or resting directly on a flat side of the light exit panel.

According to an embodiment, the micro-optical array has a light entry panel disposed in the main emission direction, downstream of the microshutter array, and a light exit panel disposed in the main direction, upstream of the microshutter array. The micro-optical entry elements are used to pre-form the light before it is mapped by the micro-optical exit elements according to the desired light distribution.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
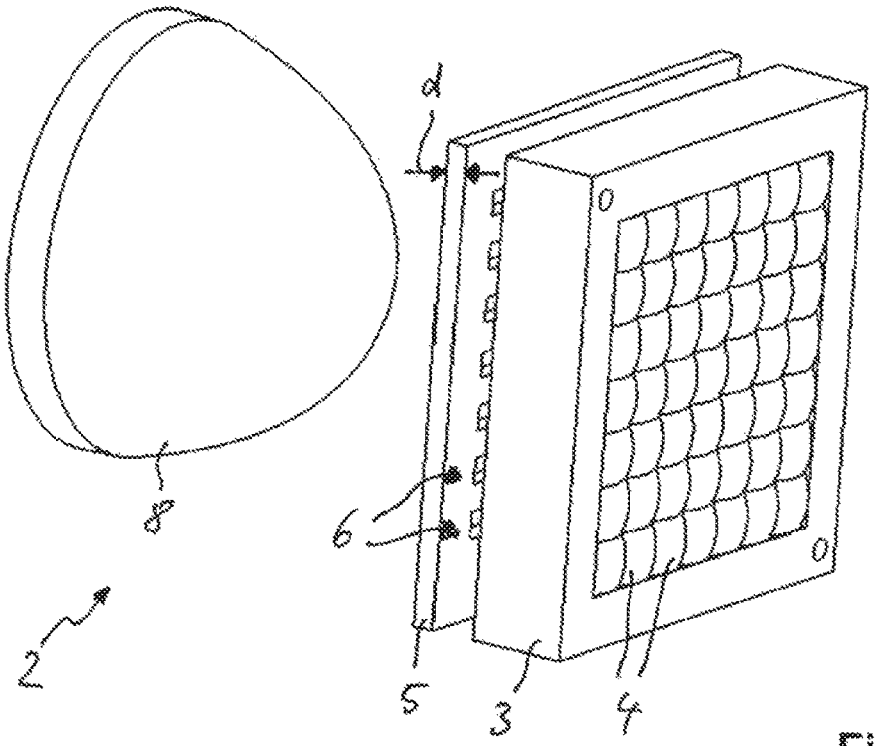
FIG. 1 is a perspective illustration of a lighting device according to an embodiment, viewed laterally from the front.
Figure 2:
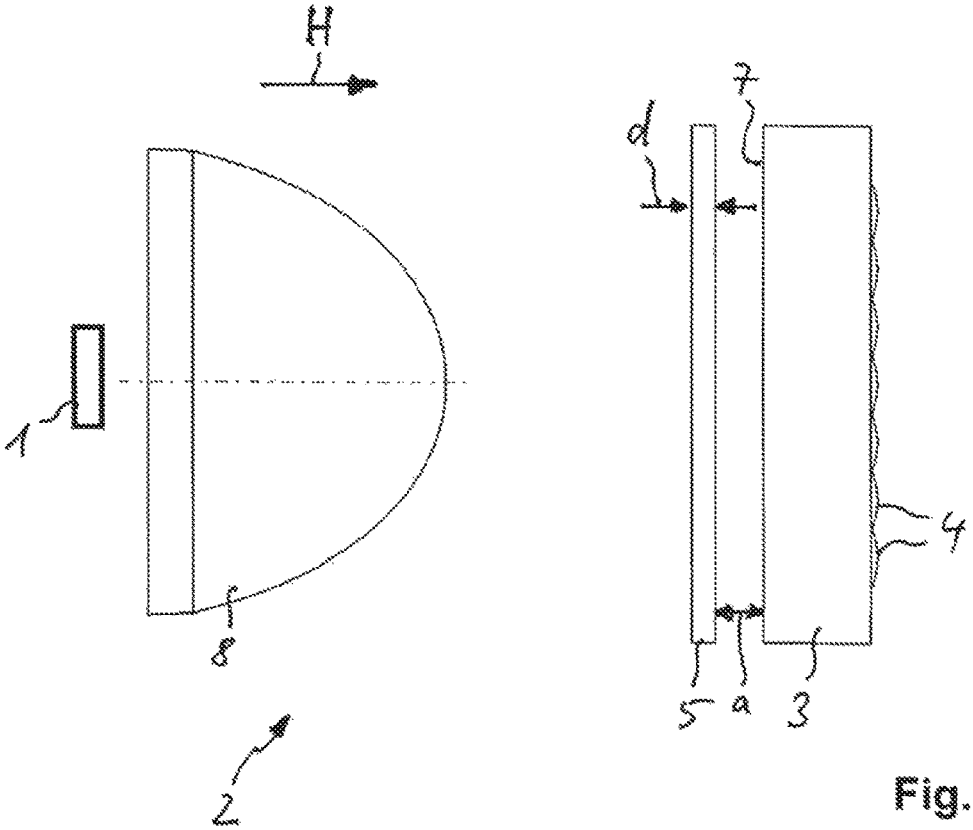
FIG. 2 is a side view of the lighting device according to FIG. 1.
Figure 3:
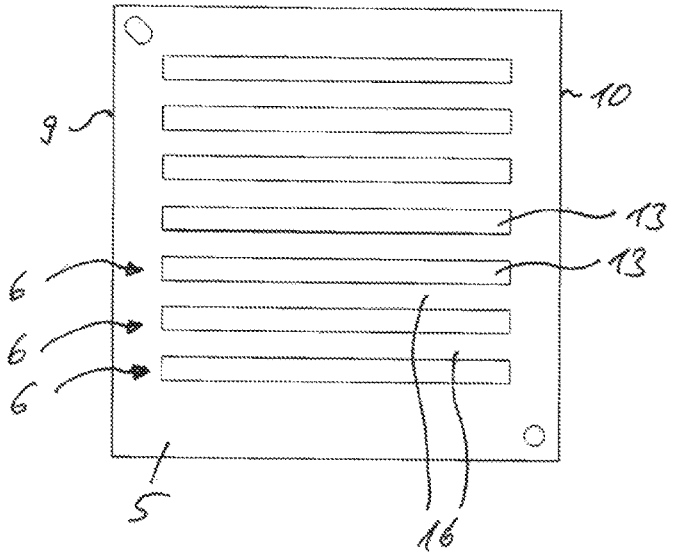
FIG. 3 is a front view of a microshutter array according to an embodiment.
Figure 4:
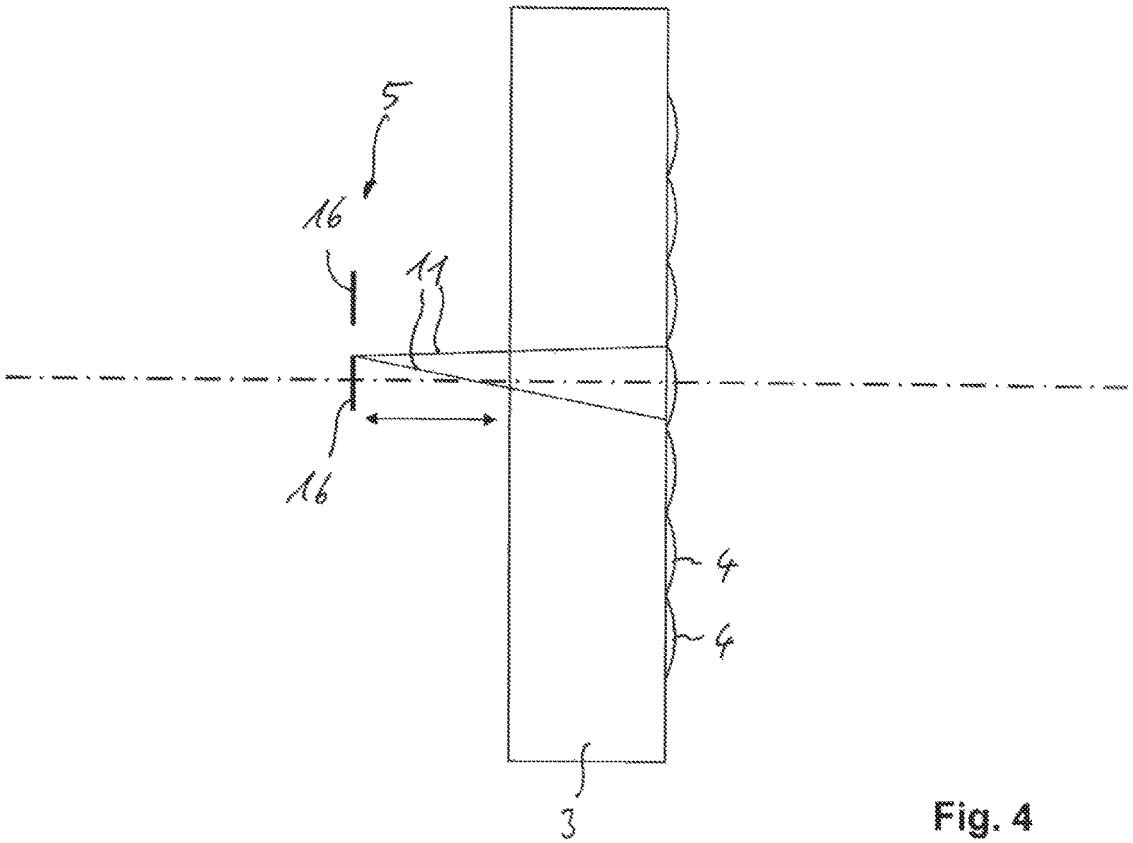
FIG. 4 is a side view of the micro-optical array of the lighting device according to the embodiment with indicated cut-off rays starting from an edge of a microshutter element of the microshutter array according to FIG. 3.

A lighting device according to the invention for vehicles can be used as a headlight for generating a low beam with a light/dark cut-off or other light distribution. Alternatively, the lighting device can be used to produce geometrically delimited shapes, such as lettering, symbols or simple geometric figures, such as rectangles, squares, etc.

According to an embodiment of the invention according to FIGS. 1 to 4, the lighting device comprises a light source 1 and an optical unit 2 for generating the predetermined light distribution, which is disposed in the main emission direction H of the lighting device, upstream of the light source 1. The optical unit 2 has a micro-optical array 3 with a plurality of micro-optical elements 4, which are arranged on a front side of the micro-optical array 3 as viewed in the main emission direction H. Downstream of the micro-optical array, in the main emission direction, a microshutter array 5 is arranged with a plurality of microshutter elements 6, wherein said microshutter array 5 is arranged at a distance a from a flat and optics-free rear side 7 of the micro-optical array 3. Further, the optical unit 2 comprises a lens 8 arranged between the light source 1 and the microshutter array 5, which serves as an optical head to substantially parallelize the light emitted from the light source 1 before it impinges on the microshutter array 5.

The micro-optical array 3 is designed as a light exit panel. The micro-optical elements 4 are arranged as micro-optical exit elements and have a dimension in the micron range. The micro-optical exit elements 4 are arranged like a matrix in rows and columns, wherein they each have the same dimension.

The microshutter elements 6 of the microshutter array 5 are each elongated and are arranged running in the horizontal direction. As can be seen from FIG. 3, the microshutter elements 6 each have rectangular apertures 13, which extend continuously from a first upright narrow edge 9 to an opposite and parallel running second narrow edge 10 of the microshutter array 5. The microshutter elements 6 or the apertures 13 are arranged at a vertical distance b, preferably equal distance b, from one another. The rectangular apertures 13 of the microshutter elements 6 are each associated with a different row of micro-optical exit elements 4, that is, in a horizontal projection, each aperture 13 covers a row of the micro-optical exit elements 4 or is arranged downstream of a row of micro exit elements 4 in the main emission direction H. The microshutter elements 6 thus have an elongated contour so that light 11 passing through the respective microshutter elements 4 strikes several micro-optical exit elements 4. In the present exemplary embodiment, a lower edge 12 of the aperture 13 serves for imaging the light/dark cut-off of the light distribution, in the present embodiment, of a front end light distribution. As is evident from FIG. 4, the microshutter array 5 is disposed in a focal plane of the micro-optical exit elements 4.

The microshutter elements 4 have elongated webs 16 running in the horizontal direction, between which the elongated, preferably rectangular apertures 13 extend.

The microshutter array 5 has a thickness d in the range of 0.1 mm to 2.00 mm. The microshutter array 5 is designed as a rigid component, which can be manufactured, for example, by injection molding. The injection-molded part thus formed can be attached to a housing of the lighting device. The microshutter array 5 can, for example, be made from a metal material or a plastic material. It is formed of a non-transparent material.

Figure 5:
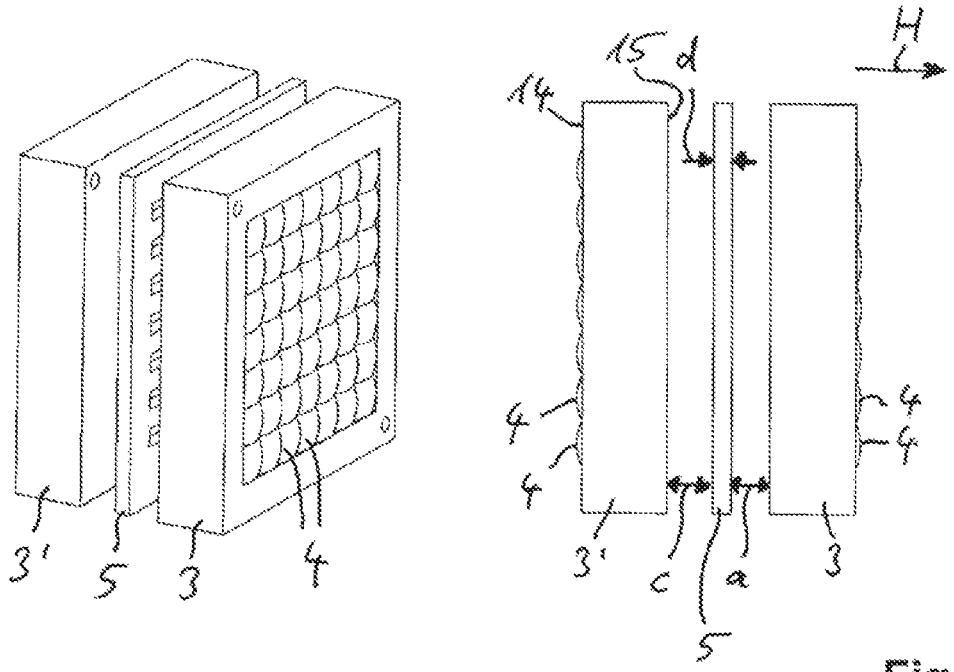
FIG. 5 is a perspective illustration and side view of the lighting device according to an embodiment.

According to an embodiment of the lighting device according to FIG. 5, the optical unit 2 additionally comprises an micro-optical entry panel 3', which is arranged in the main emission direction H, downstream of the microshutter array 5 at a distance c. For purposes of simplification, the lens 8 and the light source 1 are not shown. The micro-optical entry panel 3' and the micro-optical exit panel 3 form the micro-optical array, wherein the micro-optical entry panel 3' constitutes a light entry panel.

The micro-optical entry panel 3' has micro-optical elements 4 on a rear side 14 facing away from the microshutter array 5 which, like the micro-optical elements 4 of the micro-optical exit panel 3, are designed in the form of a lens. A front side 15 of the micro-optical entry panel 3'—such as the rear side 7 of the micro-optical exit panel 3—is designed planar. The micro-optical entry panel 3', the micro-optical exit panel 3 and the microshutter array 5 are disposed parallel to each other and, respectively, in the vertical direction.

Figure 6:
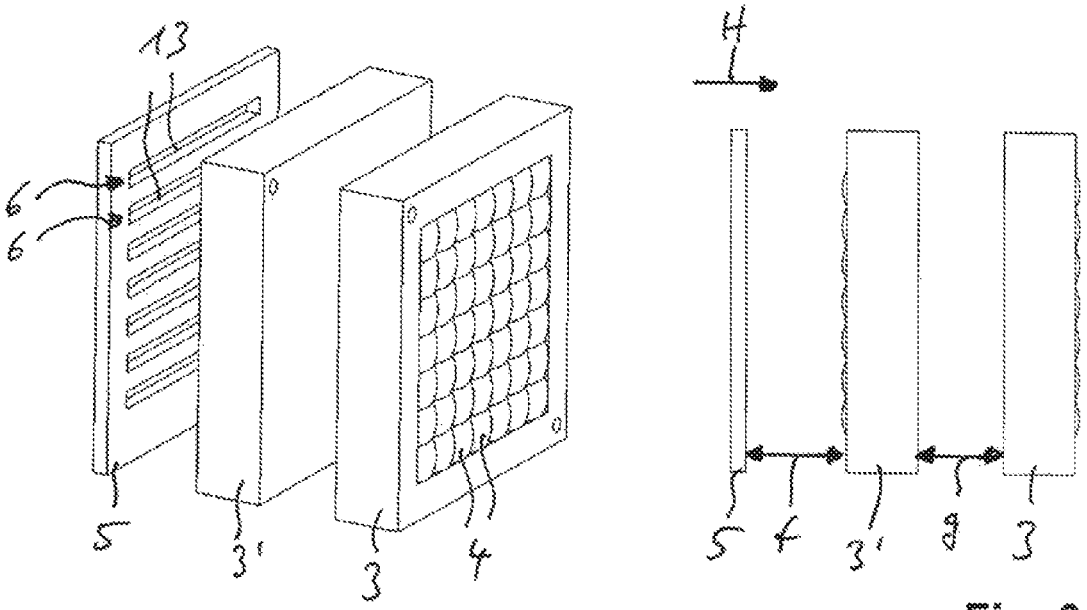
FIG. 6 is a perspective illustration and side view of the lighting device according to an embodiment.

According to an embodiment of the invention according to FIG. 6, the microshutter array 5 is disposed in the main emission direction H, downstream of the micro-optical entry panel 3' and the micro-optical exit panel 3. It is thus situated between the micro-optical entry panel 3' and the lens 8 or the light source 1. The microshutter array 5 is disposed at a distance f from the micro-optical entry panel 3'. The micro-optical entry panel 3' is located at a distance g from the micro-optical exit panel 3.

Figure 7:
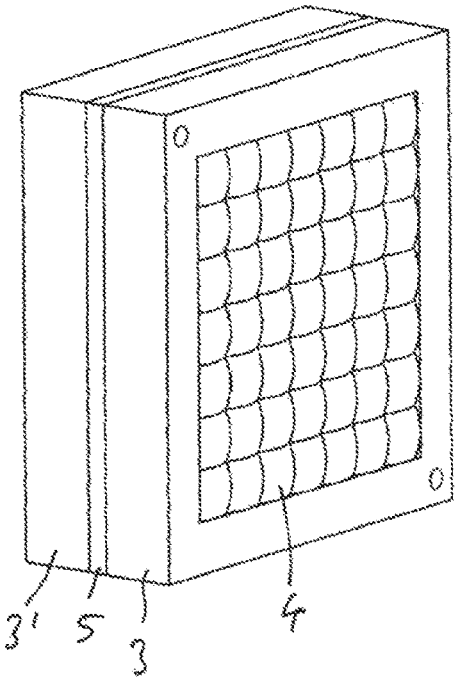
FIG. 7 is a perspective illustration and side view of the lighting device according to an embodiment.
Figure 7:
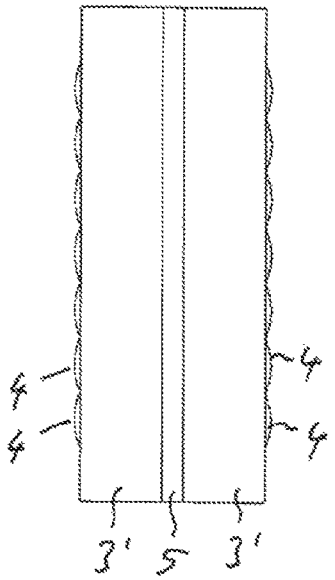

According to an embodiment of the invention according to FIG. 7, the distance between the microshutter array 5 on the one hand, and the micro-optical entry panel 3' and the micro-optical exit panel 3, can be zero. This means that the microshutter array 5 rests directly in planar contact with the front side 15 of the micro-optical entry panel 3' and with the rear side 7 of the micro-optical exit panel 3. The microshutter array 5 can, for example, be mechanically clamped between the micro-optical entry panel 3' and the micro-optical exit panel 3. Alternatively, the microshutter array 5 can also be glued to the micro-optical entry panel 3' and the micro-optical exit panel 3.

According to an embodiment of the invention, the assembly illustrated in FIG. 7 has the micro-optical entry panel 3', the microshutter array 5 and the micro-optical exit panel 3 may be integrally formed, wherein the microshutter array 5, for example, is extrusion-coated to form the micro-optical entry panel 3' and the micro-optical exit panel 3. For this purpose, the microshutter array 5 is inserted into a mold cavity of an injection molding machine as an insertion element. Alternatively, the component may also be made by means of two-component injection molding.

Figure 8:
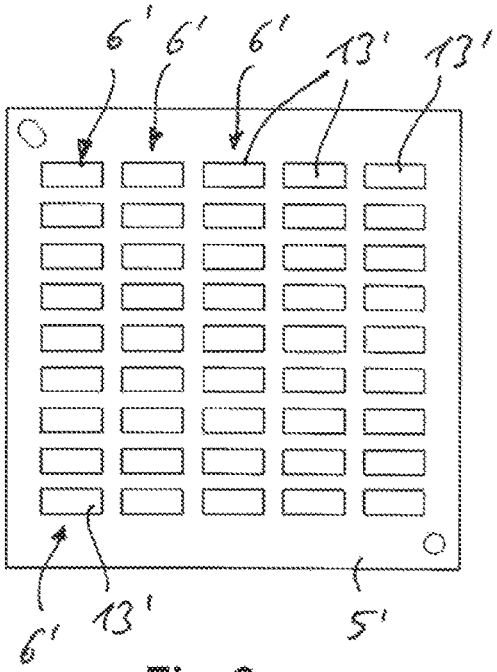
FIG. 8 is a front view of a microshutter array according to an embodiment and FIG. 9 is a front view of a microshutter array according to an embodiment.
Figure 9:
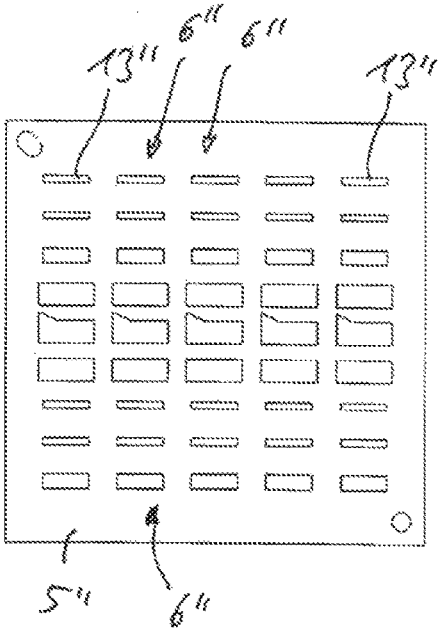

According to an embodiment of the microshutter array 5 according to FIG. 8, a microshutter array 5' can be provided which has a plurality of microshutter elements 6', which are respectively assigned to the micro-optical elements 4. These have rectangular apertures 13' of the same dimension, wherein the apertures 13' cover the micro-optical elements 4 in the horizontal projection.

According to an embodiment of a microshutter array 5", this has—same as microshutter array 5'—a number of apertures 13" corresponding to the number of micro-optical elements 4 of the micro-optical entry panel 3' or the micro-optical exit panel 3. However, the microshutter elements 6" are designed in such a way that the apertures 13" differ row-wise. In each row, the apertures 13" have the same dimension. Advantageously, different light distributions can thus be produced with a single microshutter array 5".

It should be understood that the features disclosed in an exemplary manner can be combined arbitrarily and are thus covered by the invention. The light source 1 is preferably an LED light source. It can also has several LED light sources (LED chips). For example, the lighting device described can be designed as a light module. For a headlamp function, several light modules can be installed in one housing. The light sources 1 of the light modules or groups of light sources 1 and light modules can be controlled independently of each other.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for vehicles comprising:

a light source; and an optical unit for generating a predetermined light distribution, the optical unit comprising a micro-optical array having a plurality of micro-optical elements and a microshutter array having at least two microshutter elements, wherein the microshutter array has a thickness in a range of 0.1 mm to 2.00 mm, and wherein the microshutter array is arranged entirely between the light source and all portions that together form an entirety of the micro-optical array.

2. The lighting device according to claim 1, wherein the microshutter elements have a contour such that when the microshutter array is projected onto the micro-optical array, at least two micro-optical elements are covered by a single microshutter element.

3. The lighting device according to claim 1, wherein the microshutter elements each run elongated in the horizontal and/or in the vertical direction.

4. The lighting device according to claim 1, wherein the microshutter elements of the microshutter array are each assigned to a single micro-optical element of the same micro-optical array, and wherein all microshutter elements or the microshutter elements arranged in a horizontal direction have a same contour.

5. The lighting device according to claim 1, wherein the microshutter array is an injection-molded part that is manufactured using injection molding.

6. The lighting device according to claim 1, wherein the micro-optical array has a light exit panel having at least two micro-optical exit elements, wherein the light exit panel is located at a distance to the microshutter array.

7. The lighting device according to claim 6, wherein the micro-optical array has a light entry panel having at least two micro-optical entry elements, wherein the light entry panel is arranged at a distance to the microshutter array.

8. The lighting device according to claim 1, wherein the microshutter array is formed of a metal material.

9. The lighting device according to claim 1, wherein a surface of the microshutter array that has the at least two microshutter elements is arranged between the light source and the micro-optical array.

10. The lighting device according to claim 1, wherein the microshutter array has a plurality of rows of the microshutter elements, and wherein the microshutter elements of one row are shaped differently from the microshutter elements of an adjacent row.

11. The lighting device according to claim 1, wherein the micro-optical array has a light entry panel and a light exit panel, such that after light exits the microshutter array, the light then enters the light entry panel before entering the light exit panel.

* * * * *